US007864132B2

(12) United States Patent
Boisbouvier et al.

(10) Patent No.: US 7,864,132 B2
(45) Date of Patent: Jan. 4, 2011

(54) ACTIVE PHOTONIC FORBIDDEN BAND ANTENNAE

(75) Inventors: Nicolas Boisbouvier, Evian les Bains (FR); Ali Louzir, Rennes (FR); Françoise Le Bolzer, Rennes (FR); Anne-Claude Tarot, Etrelles (FR); Kouroch Mahdjoubi, Cesson (FR)

(73) Assignee: Thomson Licensing, Boulogne-Billancourt (FR)

( * ) Notice: Subject to any disclaimer, the term of this patent is extended or adjusted under 35 U.S.C. 154(b) by 548 days.

(21) Appl. No.: 11/793,091

(22) PCT Filed: Nov. 24, 2005

(86) PCT No.: PCT/FR2005/050986

§ 371 (c)(1),
(2), (4) Date: May 5, 2008

(87) PCT Pub. No.: WO2006/061414

PCT Pub. Date: Jun. 22, 2006

(65) Prior Publication Data

US 2009/0096695 A1 Apr. 16, 2009

(30) Foreign Application Priority Data

Dec. 14, 2004 (FR) ..... 04 52965

(51) Int. Cl.
*H01Q 19/00* (2006.01)

(52) U.S. Cl. ..... 343/833; 343/834; 343/837

(58) Field of Classification Search ..... 385/33, 385/125; 376/444, 435, 409, 370, 333, 216; 343/901, 895, 882, 797, 791, 787, 785, 770, 343/715, 702, 700 MS, 833, 834, 837, 909, 343/795, 773, 815, 893; 250/292, 290, 288, 250/282

See application file for complete search history.

(56) References Cited

U.S. PATENT DOCUMENTS

| | | | |
|---|---|---|---|
| 4,728,805 | A | 3/1988 | Dempsey |
| 5,293,172 | A | 3/1994 | Lamberty et al. |
| 2004/0027646 | A1 | 2/2004 | Miller et al. |

FOREIGN PATENT DOCUMENTS

| | | |
|---|---|---|
| EP | 1111718 | 6/2001 |

OTHER PUBLICATIONS

G. Poilasne et al: "Antenna beam forming using active metallic photonic band-gap materials", Antennas and Propagation Society, 1999, IEEE Int'l Symposium 1999, Jul. 11-16, 1999, vol. 2, Jul. 11, 1999, pp. 1328-1331.

M.L. Vanblaricum: "A brief history of photonic antenna reconfiguration" Microwave Photonics, 2000, Int'l Topical Meeting on Sep. 11-13, 2000, pp. 9-12.

Search Report Dated Mar. 7, 2006.

*Primary Examiner*—Douglas W Owens
*Assistant Examiner*—Jae K Kim
(74) *Attorney, Agent, or Firm*—Robert D. Shedd; Jeffrey M. Navon

(57) ABSTRACT

The present invention relates to an active photonic band gap antenna. In this case, the photonic band gap structure is constituted by metal rods, some of which are discontinuous, namely composed of sections of rods connected by a switching element such as a PIN diode. According to the invention, only one rod in a row of rods seen from the radiating source is discontinuous. The antenna pattern can be controlled at a low cost.

6 Claims, 3 Drawing Sheets

Figure 1:
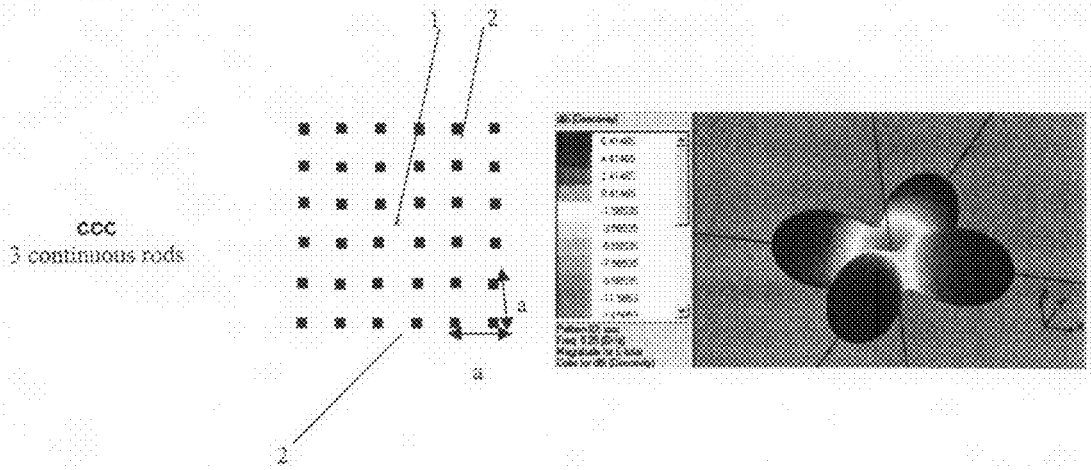

$$H = (n_e+1) \times L + n_e \times e \qquad (2)$$

$$H = (n_e+1) \times L + n_e \times e \qquad (2)$$

ACTIVE PHOTONIC FORBIDDEN BAND ANTENNAE

This application claims the benefit, under 35 U.S.C. §365 of International Application PCT/FR2005/050986, filed Nov. 24, 2005, which was published in accordance with PCT Article 21(2) on Jun. 22, 2006 in French and which claims the benefit of French patent application No. 0452965, filed Dec. 14, 2004.

The present invention relates to active photonic band gap antennas.

The photonic band gap structures (PBG) are periodic structures that prohibit wave propagation for certain frequency bandwidths. These structures were first used in the optical field but, in recent years, their application has extended to other frequency ranges. Photonic band gap structures are notably used in microwave devices such as filters, antennas or similar devices.

Among the photonic band gap structures, we find metal structures that use a periodic distribution of metallic elements, others a periodic distribution of dielectric elements but also metal-dielectric structures.

The present invention relates to a photonic band gap structure using metal elements, more particularly parallel rods completely conductive and arranged periodically, some of the rods being formed of sections connected by a switching element that, depending on its status, renders the rod continuous or discontinuous.

Photonic band gap antennas using metal elements such as metal rods have already been studied. Hence, the article published in the Chin. Phys. Lett. Vol. 19, no. 6 (2002) 804 entitled "Metal Photonic Band Gap Resonant Antenna with High Directivity and High Radiation Resistance", by Lin Qien, FU-Jian, HE Sai-Ling, Zhang Jian-Wu studies a metal photonic band gap resonant structure formed by infinitely long parallel metal rods according to the direction Z.

It is also described in an article entitled "A Beam Steering Antenna Controlled with a EBG Material" by P. Ratajczak, P. Y. Garel, P. Brachat published in the IEEE AP-S 2004, an antenna constituted by a source placed in the centre of a photonic band gap structure composed of metal rods formed by sections of rods interconnected by a PIN diode enabling the transition from the continuous state to the discontinuous state. One then speaks of active photonic band gap antennas.

The present invention relates to an improvement to an active photonic band gap antenna (PBG) that is produced with metal rods of finite length, some of which are formed by sections interconnected by a switching element that enables the rod to be rendered continuous or discontinuous. Hence, different radiation patterns can be obtained according to the position of the discontinuous rods.

The present invention relates to an active photonic band gap antenna (PBG) comprising, according to a plane of directions x, y, a radiating source and a photonic band gap structure constituted by parallel metal rods, perpendicular to the said plane, the rods of diameter d repeating themselves $n_x$ times with a period $a_x$ in the direction x and $n_y$ times with a period $a_y$ in the direction y, the rods being constituted by continuous rods and discontinuous rods formed by at least 2 sections connected by a switching element making the rod continuous or discontinuous, characterized in that one of the rods of at least one row of rods seen from the radiating source is a discontinuous rod.

According to one embodiment, the discontinuous rod comprises a number of sections t such that $t \geqq 2$. Preferably, the length L of a section is equal to $\lambda 0/2$ where $\lambda 0$ is the wavelength at the operating frequency of the antenna. Hence, the total height of a discontinuous rod is given by the formula $H=(n_e+1)L+n_e e$, wherein: $n_e$ corresponds to the number of discontinuities, L corresponds to the length of a section and e to the size of the switching element.

According to another characteristic of the invention, the discontinuous rod corresponds to the external rod of a row of rods seen from the source.

Figure 2:
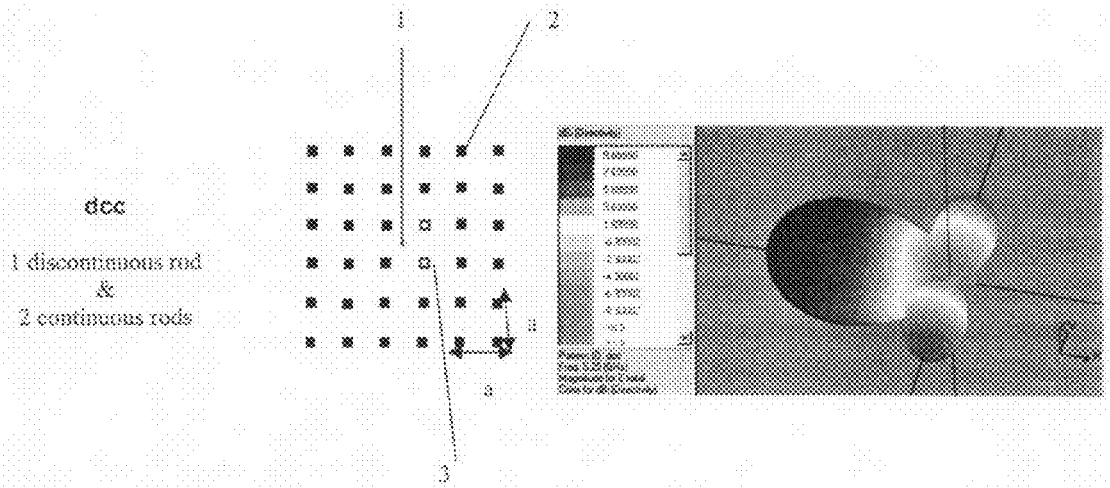
Figure 3:
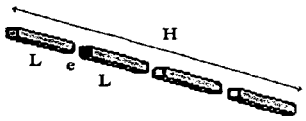
Figure 4:
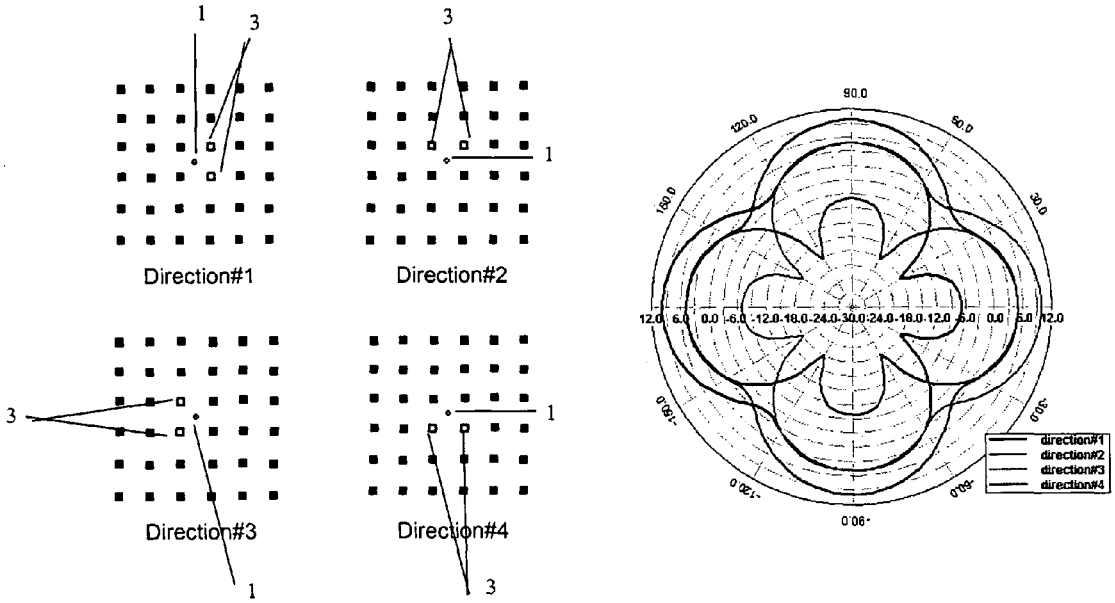
Figure 5:
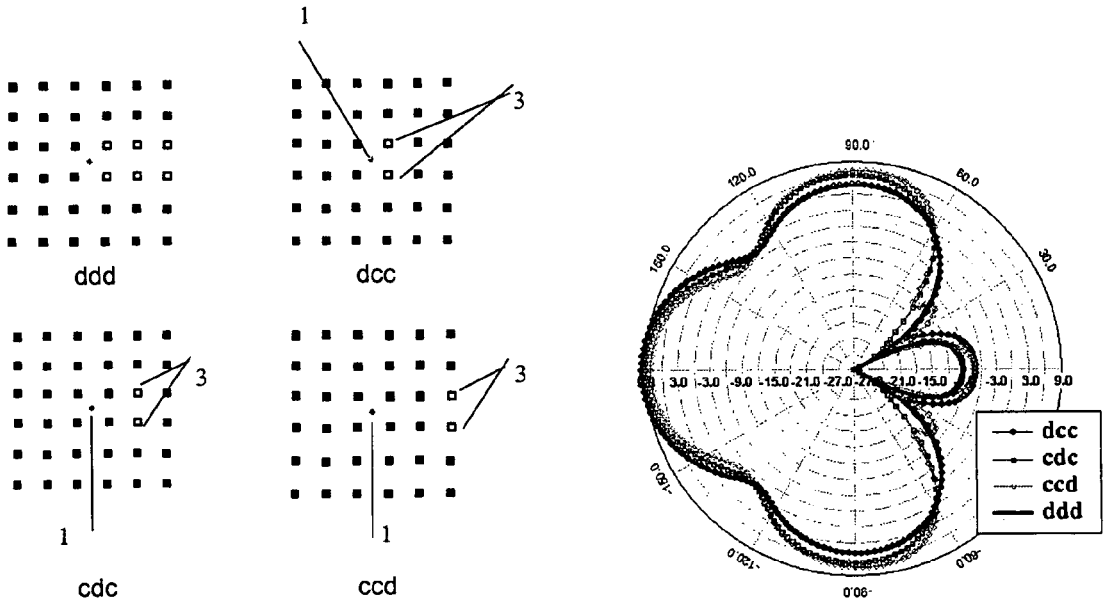
Figure 6:
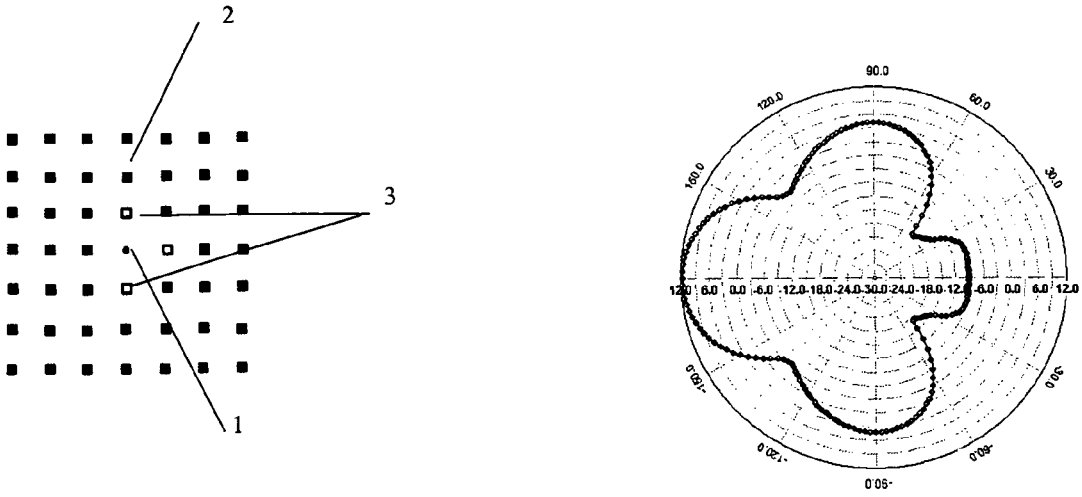

According to one embodiment, the source is a monopole mounted on a ground plane on which the rods are also mounted, a DRA (Dielectric Resonator Antenna) mounted on a ground plane, a dipole or similar. The rods are made of a metal material such as copper, silver, aluminium or similar. The switching element is chosen from the PIN diodes or MEMs, standing for MicroElectroMechanical systems Other characteristics and advantages of the present invention will emerge upon reading the following description made with reference to the drawings attached in the appendix, wherein:

FIG. 1 is a highly diagrammatic view of a photonic band gap antenna according to the prior art with its 3D radiation pattern, FIG. 2 is an identical view to that of FIG. 1 for a photonic band gap antenna according to one embodiment of the present invention, FIG. 3 is a perspective view of a discontinuous rod used in the present invention, FIG. 4 diagrammatically shows the four possible directions for the discontinuous rods as well as the corresponding radiation patterns, FIG. 5 diagrammatically shows the different possible positions for the discontinuous rods according to a given direction as well as the corresponding radiation patterns, and FIG. 6 diagrammatically shows an embodiment variant of the present invention.

To explain the concept of the present invention, a description will first be made with reference to FIG. 1, a photonic band gap antenna according to the prior art. This antenna is constituted by a radiating source formed by a dipole 1 dimensioned to operate at a frequency $f_0$=5.25 GHz and positioned in the centre of a metal photonic band gap structure or MPBG of a square form composed of 6×6 metal rods 2. The period a of the MPBG is such that the plane wave characterization shows its first propagation peak at the aforementioned frequency. Its radiation pattern as shown in FIG. 1, is therefore in the form of a rosette with four main lobes in the directions (0°, 90°, 180° and 270°). This antenna has privileged directions of radiation when the MPBG structure crossed in this direction is conductive. On the contrary, this antenna has radiation minima when the MPBG structure crossed is blocking. This blocking or conducting state is deduced from a related simulation called plane wave characterization known by those skilled in the art. The plane wave characterization involves illuminating metal rods of infinite dimensions according to the plane wave Z axis.

Hence, a source dimensioned at f=5.25 GHz (wire dipole) in the centre of an MPBG structure of 6×6 rods of period a=17.5 mm has a pattern in the form of a rosette with privileged directions of radiation in the plane $\Theta$=90° for (0°, 90°, 180° and 270°). This is explained by the fact that a plane wave characterized MPBG structure has a bandwidth at this frequency. On the contrary, in the directions (45°, 135°, 225° and 315°), the radiation pattern of the antenna has radiation minima as the plan wave characterization at this frequency for a period seen from $a'=a\sqrt{2}$=24.8 mm shows a band gap. This explains the rosette shaped radiation pattern. Moreover, this operation is obtained when a metal rod height is followed, namely $H>1.5\lambda_0$.

In FIG. 2, an active MPBG antenna is shown in accordance with the present invention. In this case, the first metal rod 3 of two contiguous rows of metal rods seen from the source 1 is a discontinuous rod according to the meaning explained below, namely a rod formed by at least 2 sections connected by a switching element that can be conductive or open such as a PIN diode or a MEMS based switch (Micro Electro Mechanical System). The energy radiated by the source 1 in the middle of the active MPBG structure is not propagated in the direction in which the 2 discontinuous rods are found, the MPBG structure being blocking, and a radiation diagram is obtained such as shown in FIG. 2 with a privileged direction of radiation opposite to the direction in which the discontinuous rods are found. This dual operation between the continuous and discontinuous rods is obtained when the length of the sections L of the metal rods forming the discontinuous rods is in the order of the half wavelength. Hence, for an operating frequency of $f_0$=5.25 GHz, L=28.6 mm.

An explanation of the sizing of a discontinuous rod is given below with reference to FIG. 3. More particularly, FIG. 3 shows a discontinuous rod and the relationship linking "H", the total height of the discontinuous rod, with the geometric parameters of the discontinuous rod. These parameters are "L", the length of the metal sections, "$n_e$", the number of discontinuities and "e", the size of the discontinuity. The following equation is therefore obtained:

$$H=(n_e+1)\times L+n_e\times e$$

Hence, for the antenna topology shown as an example, the height of the metal rods is equal to H=8.98 cm, where $n_e$=2 (2 discontinuities per rod), e=2 mm (corresponding to the size of a diode) and L=28.6 cm (as mentioned above for operation at 5.25 GHz).

We will now describe with reference to FIGS. 4 and 6, different embodiments of the present invention. Hence, in FIG. 4, two discontinuous rods 3 are positioned respectively according to the 4 directions surrounding the source 1, in this case, the obtained four possible configurations for the radiation diagram, as shown in the figure. In FIG. 5, the discontinuous rods 3 are, for the same direction, positioned according to three different arrangements, namely respectively on the first line seen from the source 1, on the second line and on the third line or outer line. The last solution makes it easer to produce the antenna as the control of the switching element such as a PIN diode is made easier by being realized on the outside of the MPBG structure. For comparison, a solution is also shown with 2 full rows of discontinuous rods 3. As shown in the figure, the associated radiation patterns are comparable enabling the energy to be prevented from propagating in the direction considered. Hence, the solution of the present invention allows the radiation pattern to be controlled with a minimum cost since only one rod per row is a discontinuous rod whose structure is more expensive owing to the fact that switching elements are used. FIG. 6 shows an MPBG antenna with 3 discontinuous rods surrounding the source 1 on three sides, the other rods being continuous rods 2. With this structure, the radiation pattern shown in FIG. 6 is obtained with directivities of 12 dB.

Hence, the radiation pattern of an active photonic band gap antenna can be controlled by only using a restricted number of discontinuous rods.

The invention claimed is:

1. An active photonic band gap antenna (PBG) comprising, according to a plane of directions x, y, a radiating source and a photonic band gap structure constituted by parallel metal rods, perpendicular to the said plane, with rods extending between the radiating source and an outermost rod, the rods of diameter d repeating themselves $n_x$ times, wherein $n_x$ is an integer greater than 0, with a period $a_x$ in the direction x and $n_y$ times, wherein $n_y$ is an integer greater than 0, with a period $a_y$ in the direction y, the rods being constituted by continuous rods and discontinuous rods formed by at least 2 sections connected by a switching element making the rod continuous or discontinuous, (wherein) one of the rods of at least one row of rods seen from the radiating source is a discontinuous rod, and wherein the height of the rods between the radiating source and the outermost rod is increasing.

2. Antenna according to claim 1, wherein the discontinuous rod comprises a number of sections t such that t≧2.

3. Antenna according to claim 1, wherein the length L of a section is equal to λ0/2 where λ0 is the wavelength at the operating frequency of the antenna.

4. Antenna according to claim 1, wherein the total height of a discontinuous rod is given by the formula $H=(n_e+1)\times L+n_e\times e$, wherein: $n_e$ corresponds to the number of discontinuities, L corresponds to the length of a section and e to the size of the switching element.

5. Antenna according to claim 1, wherein the discontinuous rod corresponds to the external rod of a row of rods seen from the source.

6. Antenna according to claim 1, wherein the source is a monopole mounted on a ground plane on which the rods are also mounted, a DRA (Dielectric Resonator Antenna) mounted on a ground plane, a dipole or similar.

* * * * *